US010058164B2

(12) United States Patent
Hanssen

(10) Patent No.: US 10,058,164 B2
(45) Date of Patent: Aug. 28, 2018

(54) CARRYING SYSTEM

(71) Applicant: Think Tank Photo, Inc., Santa Rosa, CA (US)

(72) Inventor: Joseph H. Hanssen, Fairfax, CA (US)

(73) Assignee: Think Tank Photo, Inc., Santa Rosa, CA (US)

( * ) Notice: Subject to any disclaimer, the term of this patent is extended or adjusted under 35 U.S.C. 154(b) by 0 days.

(21) Appl. No.: 15/676,972

(22) Filed: Aug. 14, 2017

(65) Prior Publication Data

US 2018/0070706 A1 Mar. 15, 2018

Related U.S. Application Data

(60) Provisional application No. 62/375,426, filed on Aug. 15, 2016.

(51) Int. Cl.
*A45F 3/04* (2006.01)

(52) U.S. Cl.
CPC ..... *A45F 3/047* (2013.01); *A45F 2003/045* (2013.01)

(58) Field of Classification Search
CPC ..... A45F 2003/045; A45F 2003/025; A45F 3/047; A45F 3/005; A45F 2003/144; A45F 2200/0533; A45F 4/02; A45F 3/04; A45C 11/38
USPC ..... 224/578–583, 195, 628, 630, 631, 646, 224/647, 650, 652, 672, 676, 681–683, 224/901–901.8; 248/205.2
See application file for complete search history.

(56) References Cited

U.S. PATENT DOCUMENTS

| | | | | |
|---|---|---|---|---|
| 384,736 | A * | 6/1888 | Bedford | A45F 3/02 224/241 |
| 3,910,470 | A * | 10/1975 | Swenson | A45C 11/38 206/316.2 |
| 5,437,403 | A * | 8/1995 | Lemanski, II | A45F 3/02 224/603 |
| 6,182,874 | B1 * | 2/2001 | Feldman, Jr. | A45C 13/30 224/259 |
| 6,702,168 | B2 * | 3/2004 | Panosian | A45C 5/00 220/694 |
| 7,909,214 | B2 * | 3/2011 | Gold | A45F 3/02 224/236 |
| 2008/0302839 | A1 * | 12/2008 | Murdoch | A45F 3/04 224/153 |

* cited by examiner

*Primary Examiner* — Adam Waggenspack
(74) *Attorney, Agent, or Firm* — R. Dabney Eastham

(57) ABSTRACT

A backpack provided with a lower compartment holds a waist bag that may encircle the waist of a bearer. A hoisting system comprising a shoulder strap attached to the waist bag allows the bearer to elevate a receiver of the waist bag when the receiver is deployed to the front of the bearer.

10 Claims, 8 Drawing Sheets

CARRYING SYSTEM

CROSS-REFERENCE TO RELATED APPLICATIONS

This non-provisional application claims benefit and priority under 35 U.S.C. § 119(e) of U.S. provisional patent application Ser. No. 62/375,426, filed on Aug. 15, 2016 and titled "CARRYING SYSTEM," the contents of which are incorporated by reference for all purposes.

TECHNICAL FIELD

The field of the invention is carriers for articles, and particularly carriers worn on the person.

BACKGROUND ART

Carriers for articles that are worn on the person include backpacks, waist bags, and chest bags.

The bearer may wish to carry certain articles, such as a camera, global positioning system navigation device, granola bar, or the like, in the backpack but have them available for ready use without taking off the backpack, because taking off the backpack and then putting it back on the bearer's back takes time and requires readjustment of the backpack when on the bearer's back. Alternatively, the bearer may not be able to take off the backpack because no place is available to place or hang the backpack after removal. A waist bag is convenient for carrying articles that need to be readily accessible because the receiver of the waist bag may be turned to the front or anterior of the bearer. Wearing a waist bag with a backpack is possible but only if the waist bag is positioned so the receiver is to the bearer's front.

The applicant is the assignee of the following U.S. patents that disclose backpacks and waist bag carrying systems that combine a backpack and a waist bag with a moveable receiver: U.S. Pat. Nos. 8,690,029 B2, 8,690,029 B2, 8,814,016 B2, 9,027,813 B2, and 9,510,661 B2. The disclosures of these patents are hereby incorporated by reference into this specification for all purposes allowed by law.

Backpack and waist bag carrying systems include a backpack with a compartment extending from side to side through the lower part of the backpack and a waist bag with a receiver. The receiver of the waist bag is sized and shaped to releasably fit into the compartment with either side of the waist bag's belt protruding from the compartment in the backpack. The bearer may then wear the backpack on the bearer's back with the waist bag's belt connected around the waist or hips of the bearer, in the manner of a conventional backpack with a waist belt.

The backpack and waist bag carrying system permits the bearer to access the needed articles readily. The bearer places the articles in the receiver of the waist bag and then inserts the receiver in the compartment of the backpack. The bearer thereupon wears the backpack on the bearer's back. When the bearer needs the article she may rotate the waist bag around the waist in order to move the receiver of the waist bag from the compartment in the bottom of the backpack to her front so she can access articles contained in the receiver. The bearer can then rotate the waist bag so the receiver returns to the compartment in the backpack. The bearer does not need to take off the backpack to access the articles.

Fishing, and particularly fly-fishing, is a sport or avocation that requires the bearer to carry a number of articles.

The fisherman or woman will need fishing gear such as a rod, reel, flies, leaders and tippets, flies or lures, tools such as a net, and the like. In addition, he or she may wish to carry other items such as food and drink, sunglasses, camera, GPS device, cellular phone, coat, sweater, gloves, and the like. A backpack is a good choice to carry all these articles, especially when the fisherman or woman must walk some distance. The backpack and waist bag carrying system is especially useful because the fisherman or woman will want quick access to certain fishing articles such as flies and tippet yet may not want to take off a backpack because he or she has no place to put the backpack (perhaps because he or she is standing in a river or on a muddy river bank). Alternatively, he or she may not want to take the time to remove and then put on the backpack just to reach a few articles.

Fishermen and women may need to wade in the water of a stream, river, lake, or the sea in order to reach or be in suitable fishing spots and to recover fish they have caught. They may wear waders in order to remain dry and warm while standing and walking in the water. Because of the need to stand or walk in water, fishermen and women may employ vests or chest packs that keep their needed articles both handy and out of water when standing in deeper water.

A backpack and waist bag carrying system places the receiver of the waist bag at waist or hip level. This may be too low because the fisherman or woman may wish to wade into water that is deeper than waist height.

A need exists for converting the waist bag of a backpack and waist bag carrying system into a chest pack, whether the bearer is wearing the backpack on his or her back in combination with the waist bag or is wearing the waist bag without the backpack. Accordingly, a need exists for a waist bag that can be converted into a chest pack.

SUMMARY OF INVENTION

In one embodiment, a backpack and waist bag carrying system is provided of the kind wherein the waist bag passes through a lower compartment in the backpack in order for the bearer to rotate the receiver of the waist bag from a position of storage in the lower compartment to a position on the front of the bearer. The backpack and waist bag carrying system incorporates a hoisting system comprising a shoulder strap adjustable in length that is attachable to the waist bag at spaced points on either side of the receiver.

In another embodiment a waist bag having a waist belt and a receiver is provided with a hoisting system comprising an adjustable length shoulder strap connectable at points on either side of the receiver.

In yet another embodiment a method is provided of elevating the receiver of a waist bag while the waist bag is being worn by a bearer.

BRIEF DESCRIPTION OF DRAWINGS

Other objects, features, and advantages of the present invention will become more fully apparent from the following detailed description of preferred embodiments, the appended claims, and the accompanying drawings in which:

Figure 1:
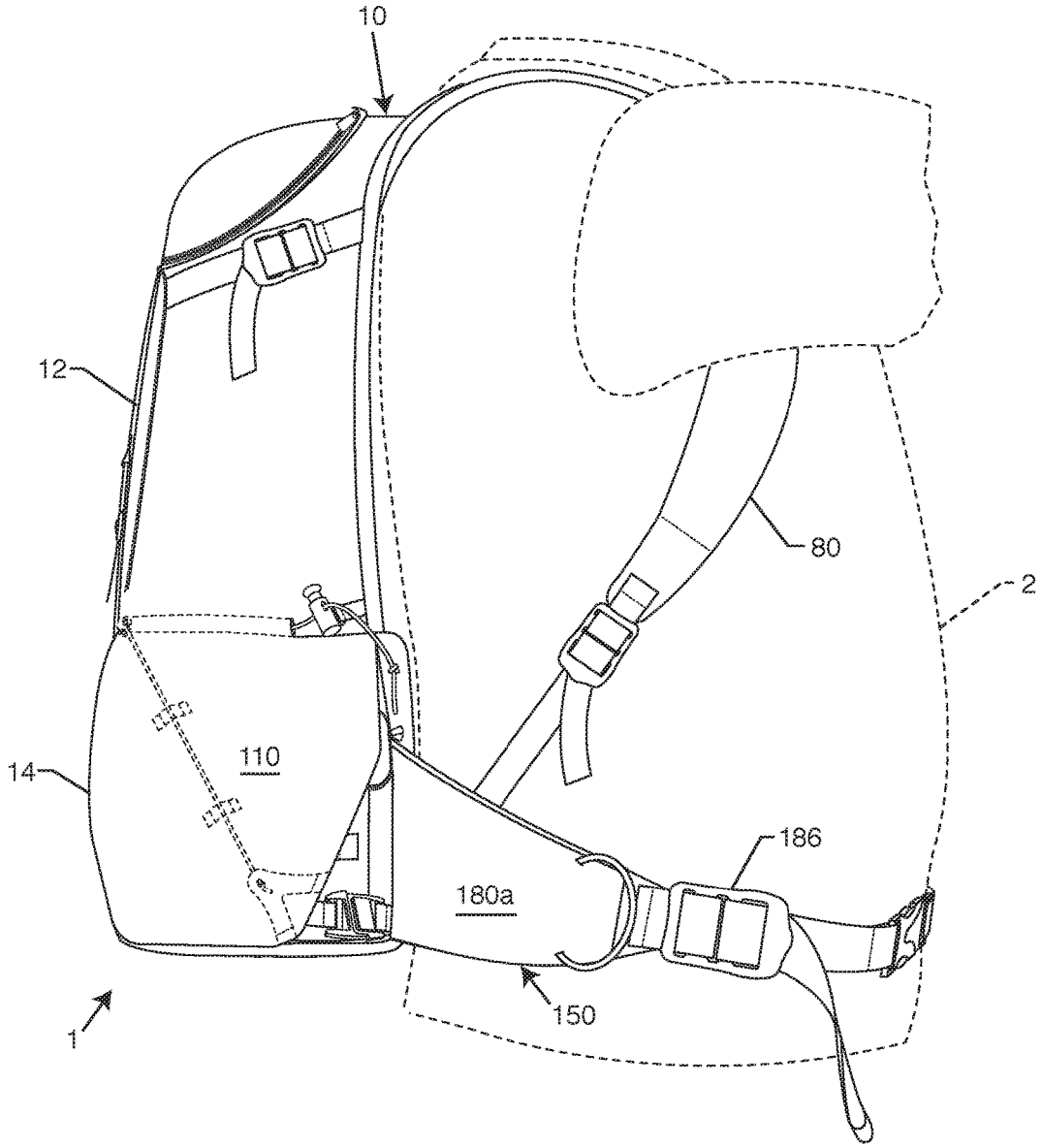
FIG. 1 is a perspective view of the right side of a preferred embodiment of a backpack and waist bag carrying system according to the invention shown being worn by a bearer.

The following table is a list of the reference numerals used in the drawings and the objects identified by the reference numerals:

1 backpack and waist bag carrying system
2 bearer
10 backpack
12 bag portion
14 lower part of bag portion
52 slot
80 right shoulder strap
82 left shoulder strap
100 lower compartment
102 opening
110 side door
111 direction side door moves to provide access to lower compartment 100
150 waist bag
160 receiver
162 body-contacting wall
164 non body-contacting wall
166 right side wall
168 left side wall
170 top wall
172 bottom wall
174 internal compartment
176 zipper
180 waist belt
180*a* right side wing of waist belt
180*b* left side wing of waist belt
182*a* right side reversibly locking buckle portion
182*b* left side reversibly locking buckle portion
184 webbing
186 webbing adjustor buckle
200 raising system
201 pouch
202 zipper
203 compartment
210 shoulder strap
220 first strap component
221 first end of the first strap component
222 second end of the first strap component
223 stitch line
234 loop
230 second strap component
231 first end
232 stitch line
233 second end
234 stitch line
240 slider buckle
250 hook
251 D-ring
255 D-ring
256 webbing loop
260 direction of pull on second strap component to raise receiver 160

DESCRIPTION OF EMBODIMENTS

Referring to the drawings, FIG. 1 shows a backpack and waist bag carrying system 1 according to the invention being worn on the back of a bearer. The backpack and waist bag carrying system 1 is much like the first embodiment of the backpack and waist bag carrying system of U.S. Pat. No. 8,814,016 B2, the contents of which have been incorporated by reference so the reader may refer to that patent for details concerning the structure of the backpack and waist bag carrying system 1. That embodiment will be described now with the differences and additions noted in detail later below. It is to be understood that other versions of a backpack and waist bag carrying system than the one shown in the drawings would be suitable.

The backpack and waist bag carrying system 1 comprises two cooperating components: a backpack 10 and a waist bag 150. The backpack 10 has a bag portion 12 that has a lower portion defining a lower compartment 100 that receives the waist bag 150, thereby providing an operative connection between the waist bag 150 and the backpack 10. The lower compartment 100 is accessed by an opening 102 on the right side of the backpack 10 and a slot 52 on the left side of the backpack 10. In this specification the terms right and left as used with respect to the backpack 10 and the waist bag 150 refer to the bearer's right and left when the backpack 10 and a receiver 160 of the waist bag 150 are worn on the bearer's posterior side of back.

Figure 2:
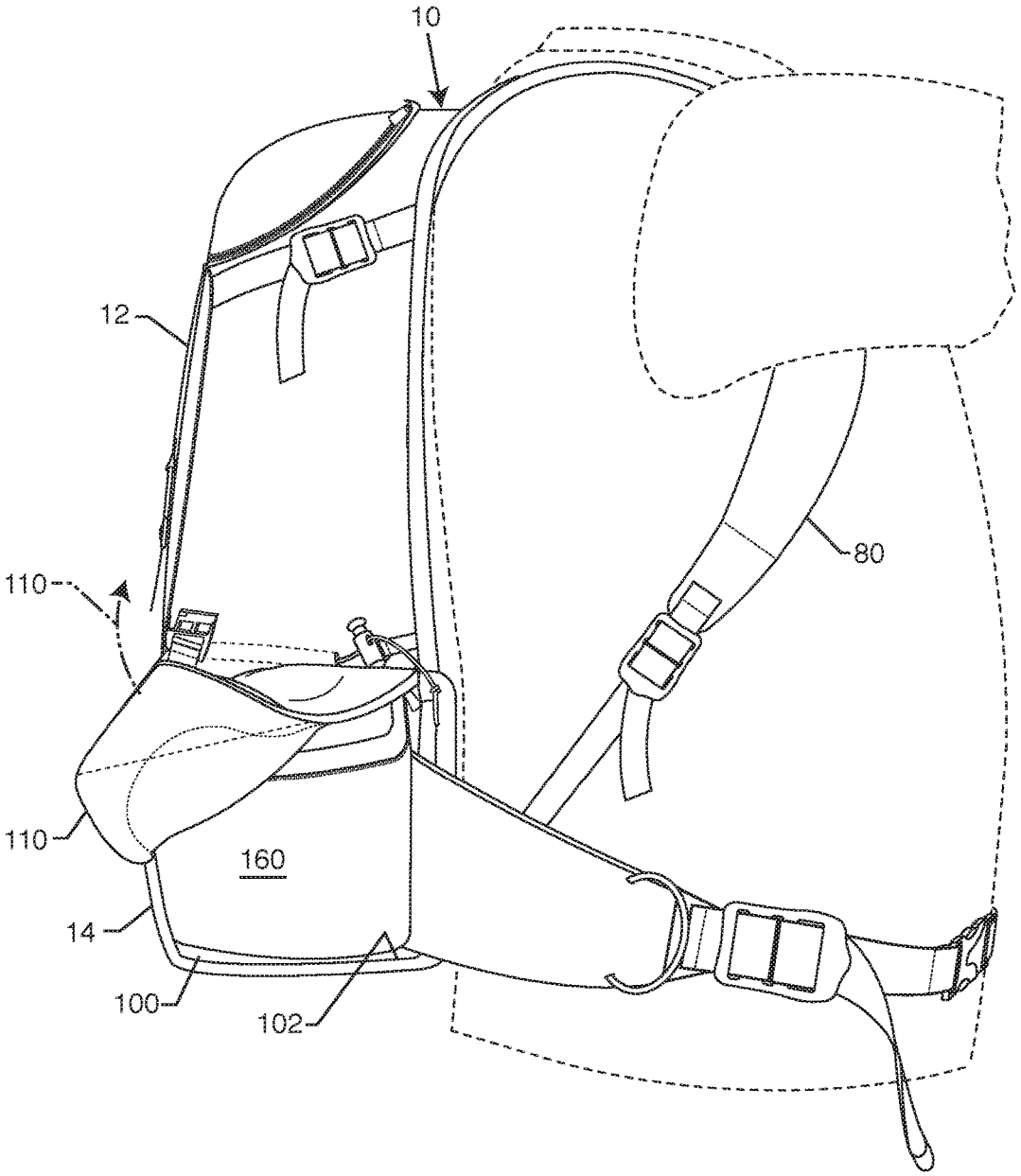
FIG. 2 is a perspective view of the right side of the backpack and waist bag carrying system of FIG. 1 showing the opening of a compartment for containing the receiver of the waist bag, but wherein the waist belt of the waist bag has been omitted to show the attachment of the shoulder straps to the bottom of the backpack.
Figure 3:
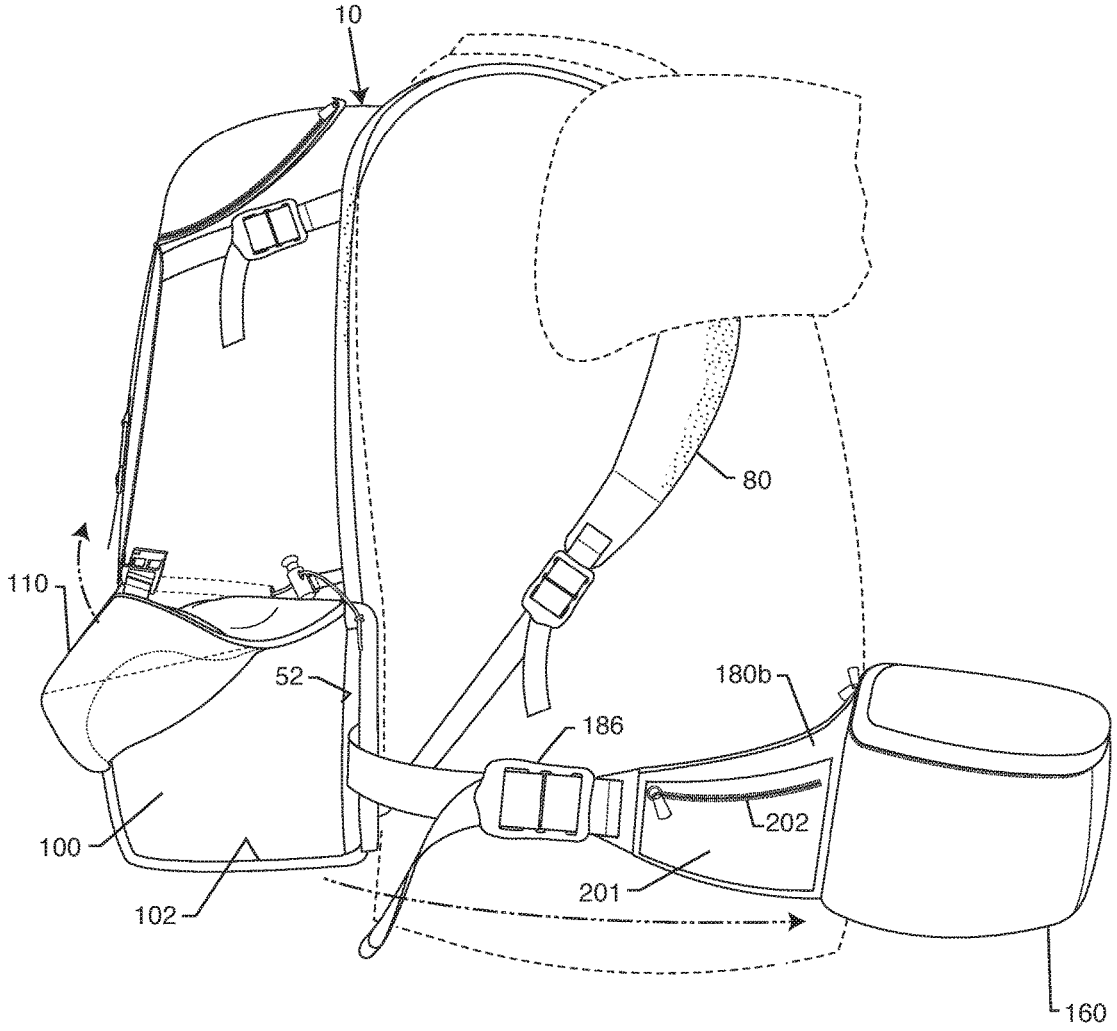
FIG. 3 is a perspective view of the right side of the backpack and waist bag carrying system of FIG. 1 showing the deployment of the receiver of the waist bag to the front of the bearer.

The bearer, shown in hidden line in the drawings and indicated by reference number 2, may wear the combination of the backpack 10 and the waist bag 150 just as he or she would wear a normal backpack when it is in a first configuration shown in FIG. 1. FIG. 2 shows the backpack 10 worn on the back of the bearer 2, but with the waist belt 180 of the waist bag 150 omitted so the lower compartment 100 of the backpack 10, the opening 102, and the slot 52 are visible.

FIGS. 1 and 2 shows the door 110 that closes the opening 102. In FIG. 1 the door 110 is secured over the opening 102 and in FIG. 2 the door 110 has been displaced from the opening 102 to show the receiver 160 of the waist bag 150. The phantom arrow 111 shows the direction the door 110 moves in order to allow the receiver 160 to exit or enter the lower compartment 100.

The backpack 10 has shoulder straps 80 and 82 that support the bag portion 12 of the backpack 10 on the back or posterior side of the bearer 2. In the first configuration, the waist bag 150 will help support the backpack 10. The waist bag 150 has a waist belt 180 encircling the waist of the bearer 2 that will support the receiver 160 of the waist bag 150 and, in the first configuration, the bag portion 12 of the backpack 10 on the back or posterior side of the bearer, by providing support from the waist.

In the first configuration, the configuration of the backpack with waist bag carrying system 1 shown in FIGS. 1 and 2, the receiver 160 of the waist bag 150 is centered in the compartment 100. The waist belt 180 (not shown in FIG. 2) of the waist bag 150 surrounds the waist, generally above the hips of the bearer, and acts as a waist belt for the backpack 10. This configuration of the backpack 10 and the waist bag 150 is similar in operation to a conventional backpack with waist belt. As will be seen, this configuration also has the appearance of a conventional backpack with waist belt because the receiver 160 is not visible to an observer when the door 110 is shut.

In the second configuration of the backpack with waist bag carrying system 1, shown in FIGS. 3 and 7-10, the bearer 2 has pulled the receiver 160 of the waist bag 150 out of the compartment 100 (preferably after loosening the waist belt 180 at one or both of the webbing adjustor buckles 186 so that the belt 180 will not resist the movement by friction with the bearer's waist) and rotated the receiver 160 of the waist bag 150 to the bearer's front or anterior side while the waist belt 180 remains buckled about the bearer's torso.

The entire waist bag 150 thus is rotated around the bearer's waist without removing the backpack 10 from the bearer 2. In this configuration the bearer 2 will have access to the contents of the receiver 160 of the waist bag 150 without having to remove the backpack 10. The waist bag 150 will remain operatively connected to the backpack 10. It will be noted that the waist bag 150 preferably is worn over the shoulder straps 80 and 82 so that the shoulder straps 80 and 82 do not prevent rotation of the waist bag 150 by interfering with the movement of the receiver 160.

The receiver 160 of the waist bag 150 is withdrawn from the right side of the compartment 100 in the bag portion 12 of the backpack 10, while the backpack 10 is worn on the body of the bearer 2. It will be understand that the side door 110 is on the right side of the bag portion 12 because most bearers are right handed and will prefer to use their right hands to unfasten the side door 110 in order to withdraw the receiver 160 from the lower compartment 100. The side door 110 could just as well be located on the left side of the bag portion 12, for the convenience of left handed bearers.

The bearer can shift or rotate the waist bag 150 back to the first configuration shown in FIG. 1 when desired without first having to remove either the backpack 10 or the waist bag 150. When in the first configuration, the backpack with waist bag carrying system 1 may be worn on the bearer's back like a conventional backpack with a waist belt. The backpack with waist bag carrying system 1 may be removed from the bearer and carried, such as by hand, as one unit. In this respect the backpack with waist bag carrying system 1, when in the first configuration, operates and may be used like any conventional backpack with a waist belt.

Figure 4:
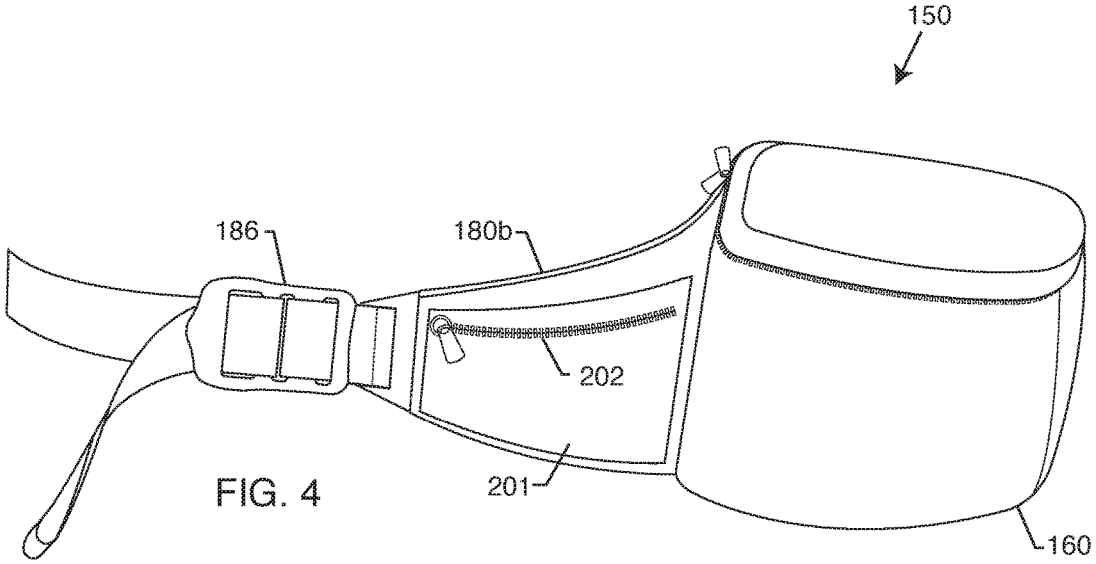
FIG. 4 is a perspective view of the left side of the waist bag of the backpack and waist bag carrying system of FIG. 1.

The user or bearer may wear the backpack 10 without the waist bag 150 or the waist bag 150 without the backpack 10, if desired. FIG. 4, for example, shows the waist bag 150 by itself.

The waist bag 150 shown in FIGS. 1 and 3-10 is like conventional waist bags in that it has a receiver 160 attached to a waist belt 180. The receiver 160 has a body contacting wall 162 and a generally opposed and parallel non-body contacting wall 164 joined by right and left side walls 166 and 168, a top wall 170, and a bottom wall 172 that define an internal compartment 174. It will be understood that the term "body contacting" means "closest to the body of the bearer" and "non-body contacting" means "side furthest from the body of the bearer." It will be understood that the receiver 160 either may be attached to a waist belt that completely encircles the bearer's waist or may form a part of the waist belt 180.

The waist belt 180 has right and left wings **180*a* and 180*b*, respectively, attached to either side of the body-contacting wall 162 of the receiver 160. The right and left wings preferably are padded, such as by forming a fabric-foam sheet-fabric sandwich, because they will fit over the iliac crests of the hips of the bearer. The right and left wings are attached to the webbing adjuster buckles 186*a* and 186*b*, which in turn are slidingly attached to the webbing straps 184. The webbing straps 184 are attached to the reversibly locking buckle portions 182*a* and 182*b* that may be detachably connected to each other to secure the waist belt 180** around the bearer's waist.

Thus far, the description of the backpack and waist bag carrying system 1 has summarized that of the first embodiment of a backpack and waist bag carrying system described in U.S. Pat. No. 8,814,016 B2. The system 1 also comprises a raising or hoisting system 200 that permits the waist bag 150 to be used as a chest bag. The components of the raising system 200 will have reference numbers in the 200 series.

Figure 5:
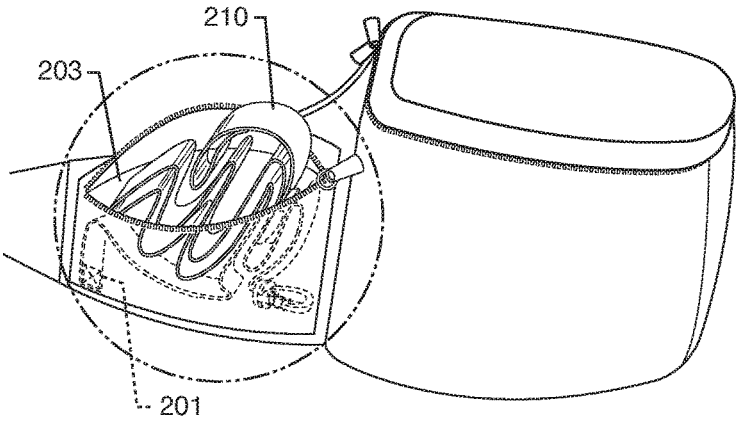
FIG. 5 is a perspective view of a portion of the waist bag of the backpack and waist bag carrying system of FIG. 1.
Figure 6:
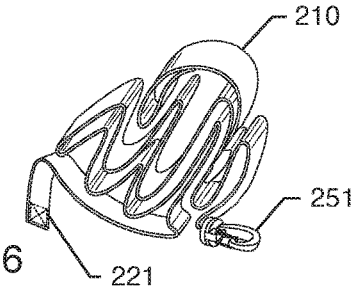
FIG. 6 is a perspective view of the shoulder strap shown in the phantom line circle shown in FIG. 5.

As shown in FIGS. 4 and 5, the waist belt 180 of the waist bag 150 has a left side wing **180*b*. A pouch or pocket 201 is mounted on the left side wing 180*b*. A zipper 202 opens and shuts an opening in the pouch 201 that allows access to a compartment 203 defined by the pouch 201. A shoulder strap 210 may be stored inside the compartment 203. The compartment 203 contains the shoulder strap 210 when the shoulder strap 210 is not in use. FIG. 6 shows the shoulder strap 210 as it would look when separated from the waist bag 150**.

FIGS. 7-10 shows the shoulder strap 210 deployed after the zipper 202 has been opened in order to allow access to the compartment 203. The shoulder strap 210 comprises a first strap component 220, a second strap component 230, and a slider buckle 240.

The first strap component 220 has a first end 221 sewn to the pouch 201 within the compartment 203. It also has a free second end 222. The free second end 222 of the first strap component 220 is looped around a bar of the buckle 240 and joined to the first strap component 220 by the stitch line 223. The length of the first strap component 230 between the slider buckle 240 and the first end 221 does not change. (It could be arranged to do so if desired.)

The second strap component 230 has a free first end 231 that is passed through the slider buckle 240 and around a bar of the slider buckle 240 so that the second strap component 230 can slide freely through the slider buckle 240 when the second strap component 220 is not under tension. The first end 231 is sewn to the second strap component at the stitch line 232 to form a loop 233 for grasping by the bearer. The second end 235 of the second strap component 230 is looped through the D-ring 251 of a hook 250 and sewn to the second strap component 230 at the stitch line 236.

The portion of the second strap component 230 extending between the D-ring 251 and the buckle 240 may be shortened by pulling the loop 233 away from the buckle 240 in the direction 260. The portion of the second strap component 230 extending between the D-ring 251 and the buckle 240 may be extended or lengthened by twisting or pulling on the buckle 240 to reduce its frictional engagement with the second strap component 230.

Figure 7:
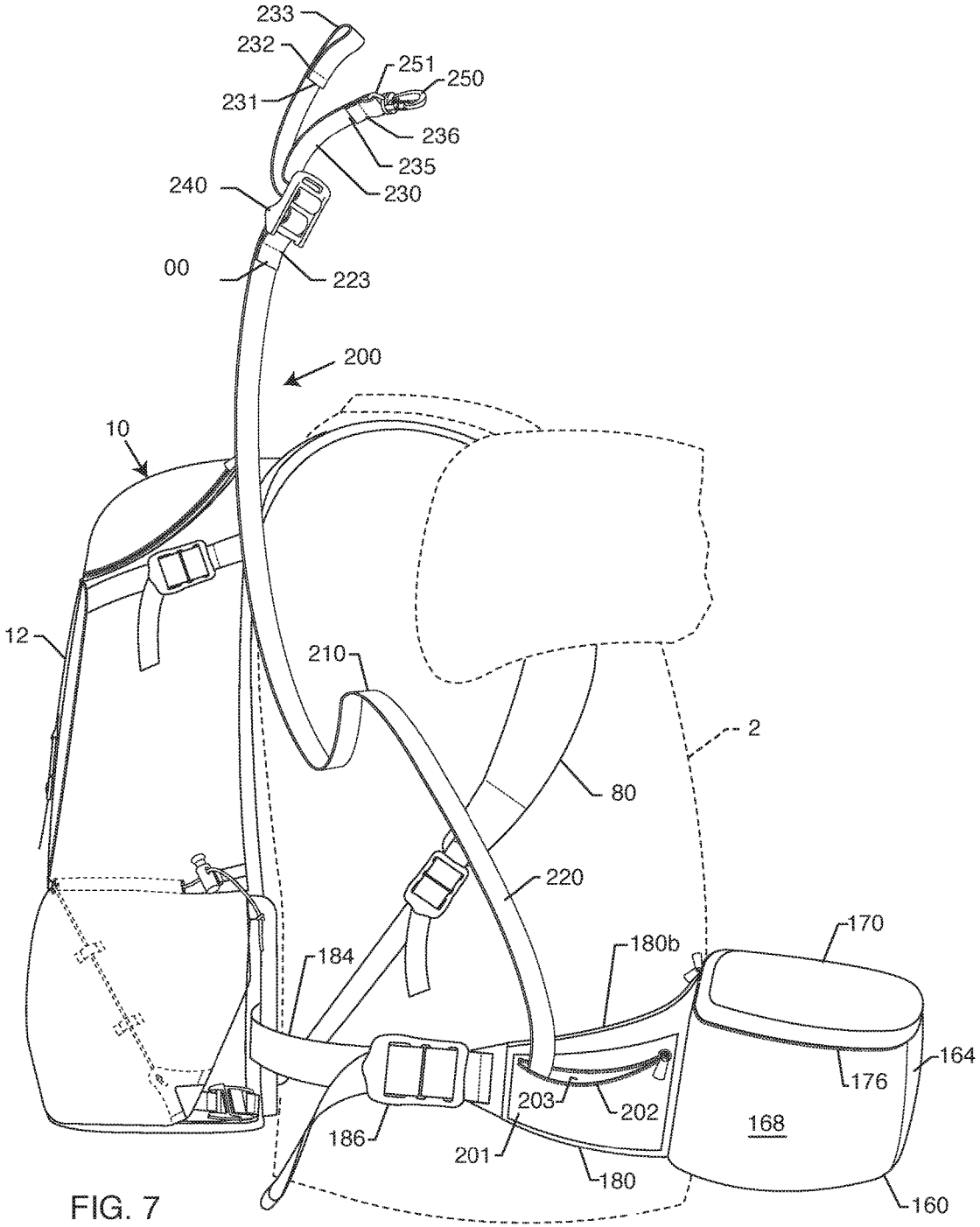
FIG. 7 is a perspective view of the right side of the backpack and waist bag carrying system of FIG. 1 in the configuration shown in FIG. 3 and showing the deployment of the shoulder strap of the hoisting system from the waist bag.
Figure 8:
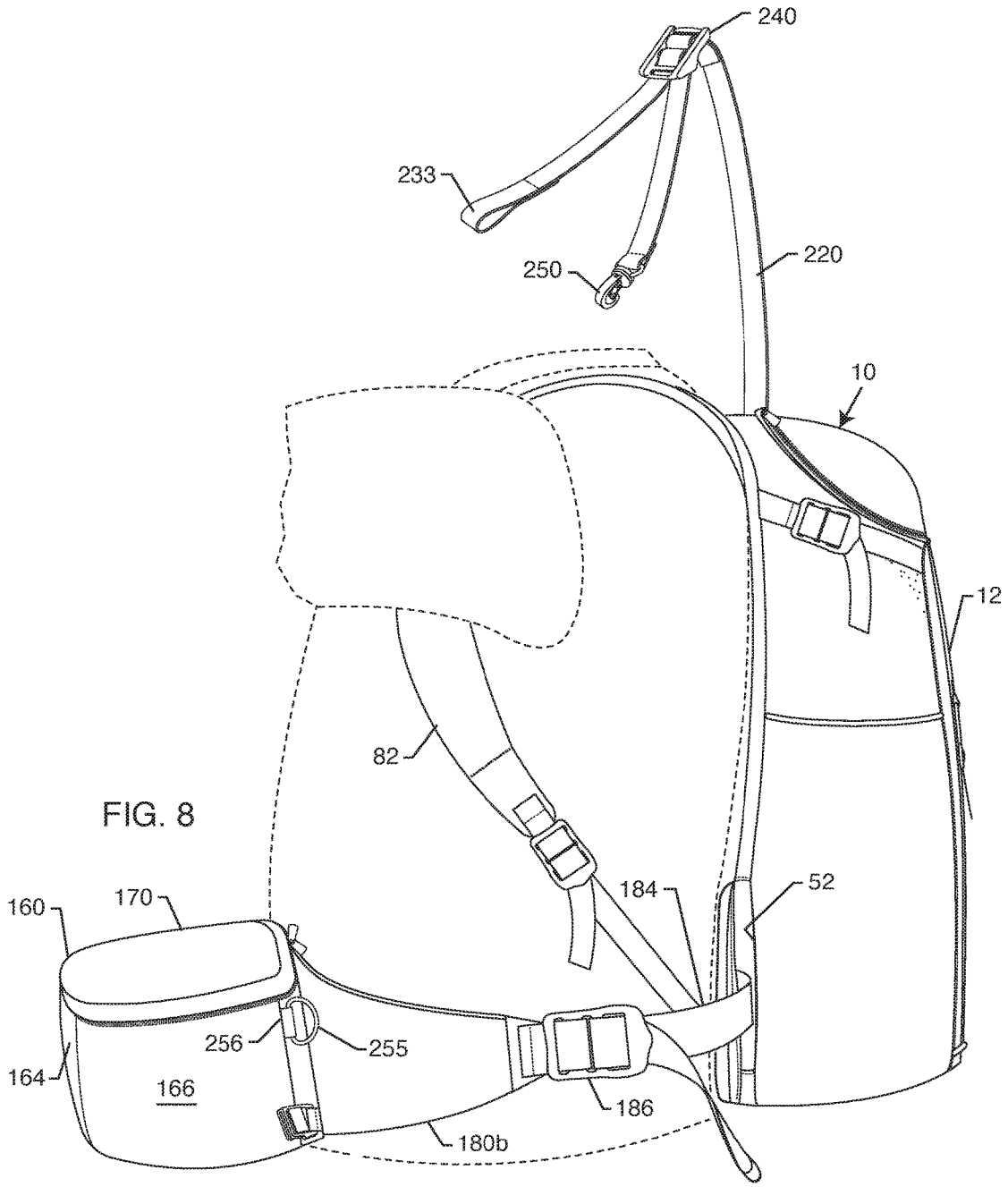
FIG. 8 is a perspective view of the left side of the backpack and waist bag carrying system of FIG. 1 in the configuration shown in FIG. 3 and showing the deployment of the shoulder strap of the hoisting system from the waist bag.
Figure 9:
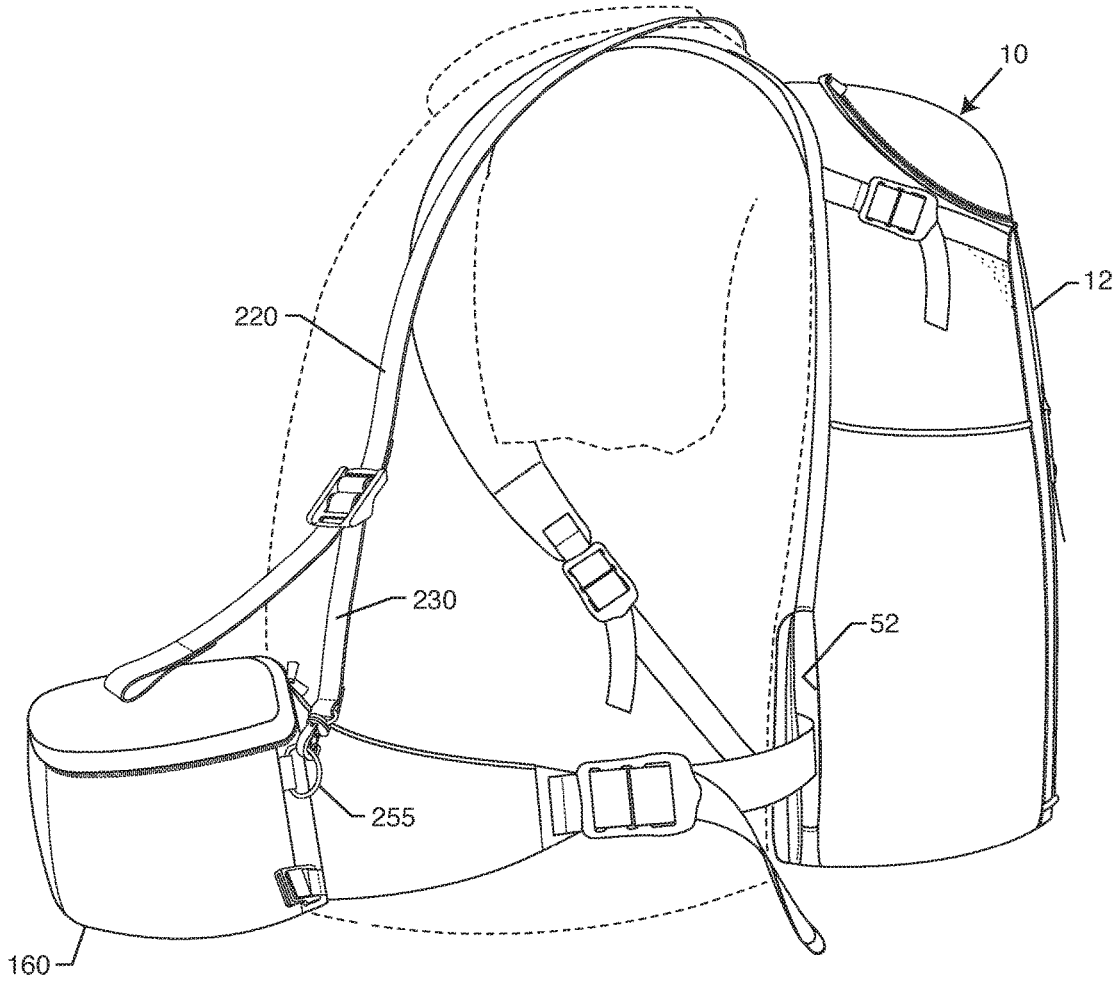
FIG. 9 is a perspective view of the left side of the backpack and waist bag carrying system of FIG. 1 in the configuration shown in FIG. 3 and showing the attachment of the free end of the shoulder strap of the hoisting system to the waist bag.

As shown in FIGS. 7 and 8, the shoulder strap 210 is brought up the right side of the bearer and passed behind the neck of the user towards and over the bearer's left shoulder. As shown in FIG. 9, the hook 250 then is connected to the D-ring 255 to the right side of the receiver 160 near its juncture with the right side wing 180*a* of the waist belt 180. The D-ring 255 is attached to the receiver 160 by a webbing loop 256 sewn into a seam of the receiver 160.

The D-ring 255 may be replaced by a loop of webbing or cord attached to the waist bag 150 on or to the right side of the receiver. The hook 250 could be a snap-link, karabiner, or the like. Alternatively, the second end 235 could be provided with hook or loop patches so the second end 235 could be pushed through the D-ring 255 and attached to a loop or hook patch further down the second strap component 230.

Figure 10:
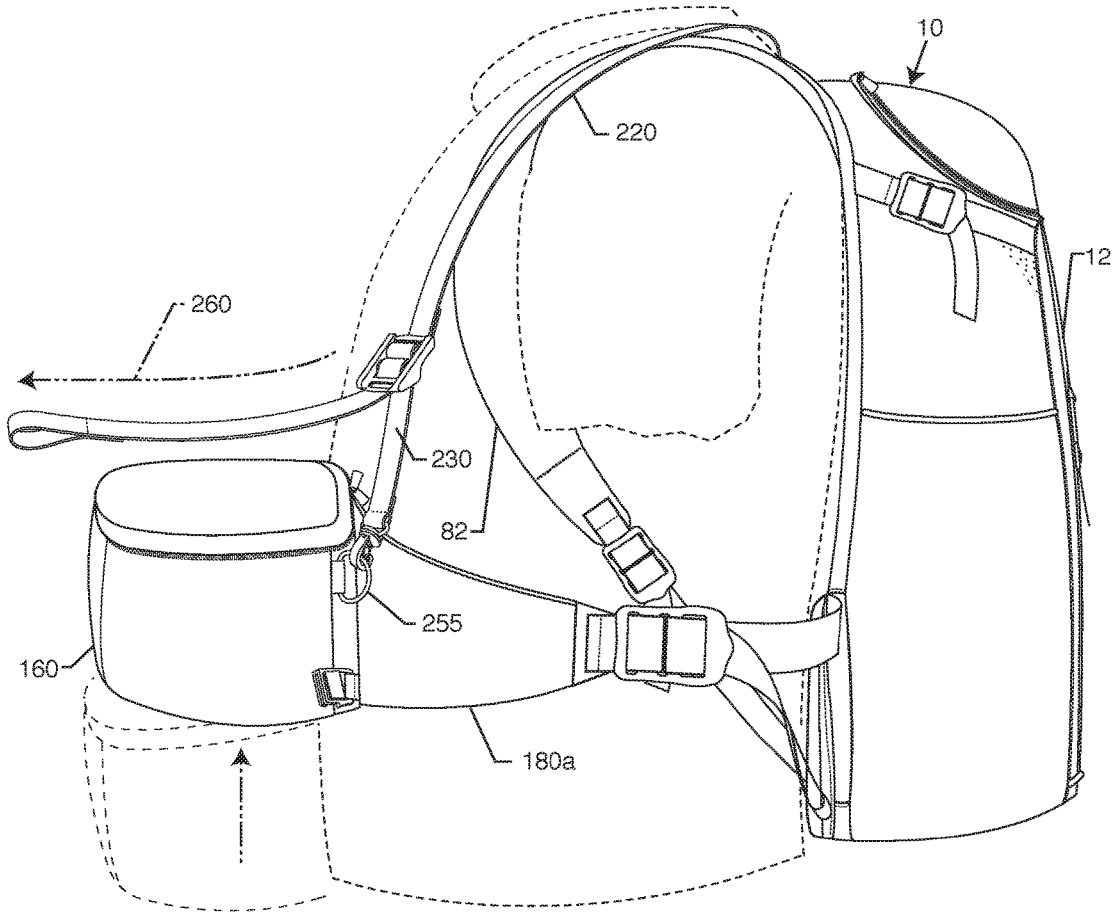
FIG. 10 is a perspective view of the left side of the backpack and waist bag carrying system of FIG. 1 in the configuration shown in FIG. 3 and showing the shortening of the shoulder strap of the hoisting system to raise the receiver of the waist bag.

FIG. 10 shows the effect of pulling on the loop 224 in the direction 260. This will shorten the length of the first strap component 220 between the slider buckle 240 and the first end 221. This action will cause the shoulder strap 210 to contract and thereby raise the receiver 160 relative to the body of the bearer (as shown by the receiver in phantom line in an initial position and in solid line in the higher position). The receiver 160 can rise up to the chest of the bearer before the right and left side wings 180*a* and 180*b* contact the tops of the slot 52 and the opening 102, respectively.

The specific details of the backpack 10, the waist bag 150, and the hoisting system 200 may be varied in detail without departing the scope of the invention. For example, the first strap component 220 may have the sliding engagement with the slider buckle 240 and the first end 231 of the second strap component 230 is attached or fixed to the slider buckle 240.

The raising system 200 can be used when the waist bag 150 is worn separately, that is, without the backpack 10. In that case the hoisting system 200 adapts the waist bag 150 to be capable of becoming a chest bag by raising the receiver 160 to the chest of the bearer.

The arrangement of the components of the system 200 are those most suitable for right-handed users. Left-handed users will prefer an arrangement in which the pouch 201 is mounted on the left side wing 180*b* and the ring 255 on the right side of the receiver 160. The hoisting system thus would be suitable for left-handed bearers, in that the shoulder strap 210 is attached to the waist bag 150 passes over the right shoulder of the bearer.

While the invention has been described in conjunction with the preferred embodiment, it will be understood that it is not intended to limit the invention to this embodiment or its particular manner of construction, materials or components. On the contrary, the invention is intended to cover alternatives, modifications and equivalents that may be included within the spirit and scope of the invention as defined by the appended claims.

What is claimed is:

1. A carrying system, comprising:

a backpack comprising a bag portion attached to shoulder straps;

the bag portion defining a compartment in a lower part of the bag portion, the lower compartment having openings on right and left sides of the lower part of the bag portion;

a waist bag comprising a receiver attached to a waist belt, wherein the waist bag extends through the openings on the right and left sides of the lower part of the bag portion and the compartment wherein the waist belt may be fastened so as to encircle a bearer's waist when the backpack is worn on the bearer's back;

wherein the receiver has a cross-sectional size and shape allowing it to be received in the compartment, whereby the bearer can rotate the waist bag around the bearer's waist, when the backpack is worn on the bearer's back, from a first position in which the receiver is contained in the compartment and adjacent the bearer's back to a second position in which the receiver is adjacent the front of the bearer;

a hoisting system comprising a shoulder strap having first and second ends, the first end of the shoulder strap being attached to the waist bag on or near one side of the receiver and the second end of the shoulder strap being attached to the waist bag on or near an opposite side of the receiver, and the shoulder strap being adapted to pass over one shoulder of the bearer, around a bearer's neck and over the other shoulder of the bearer and be reversibly shortened and lengthened while the waist bag encircles the bearer's waist and the receiver is adjacent the front of the bearer, whereby the receiver may be raised and lowered with respect to the front of the bearer.

2. The carrying system according to claim 1 further comprising a pouch mounted on or to the one side of the receiver wherein the pouch defines a compartment adapted to contain the shoulder strap for storage of the shoulder strap when it is not deployed to raise the receiver.

3. The carrying system according to claim 2 wherein the first end of the shoulder strap is attached to the pouch within the compartment adapted to receive the shoulder strap.

4. The carrying system according to claim 1 wherein the second end of the shoulder strap has a hook and a ring is attached on or to the opposite side of the receiver wherein the hook may be attached to the ring.

5. The carrying system according to claim 1 wherein the shoulder strap comprises a first strap component having an end comprising the first end of the shoulder strap, the first strap component being attached to a second strap component by a slider buckle, the second strap component having an end defining the second end of the shoulder strap, wherein one of the first or the second strap may be contacted or lengthened between the slider buckle and the first or the second end, whereby the shoulder strap may be shortened or lengthened.

6. The carrying system according to claim 5 wherein the first strap component has a second end attached to the slider buckle and the second strap component has a first end that passes through the buckle for frictional engagement of the second strap component with the slider buckle.

7. The carrying system according to claim 5 wherein the second strap component has a first end attached to the slider buckle and the first strap component has a second end that passes through the buckle for frictional engagement of the first strap component with the slider buckle.

8. A method of raising and lowering a carrier when borne on a bearer, comprising: providing a backpack comprising a bag portion attached to shoulder straps; the bag portion defining a compartment in a lower part of the bag portion, the lower compartment having openings on right and left sides of the lower part of the bag portion;

providing a waist bag comprising a receiver attached to a waist belt and having a buckle wherein the waist belt may be fastened so as to encircle a bearer's waist and the bearer can rotate the waist bag around the bearer's waist from a first position in which the receiver is contained in the compartment and adjacent the bearer's back the waist bag extending through the openings in the right and left sides of the compartment to a second position in which the receiver is adjacent the front of the bearer;

providing a hoisting system comprising a shoulder strap having first and second ends and capable of being reversibly shortened and lengthened;

fastening the waist bag around the waist of the bearer;

while the waist bag is fastened around the waist of the bearer, placing the receiver adjacent the front of the bearer whereby the receiver is in a second position;

attaching the first end of the shoulder strap to the waist bag on one side of the receiver;

passing the shoulder strap around the body of the bearer to the rear of a first shoulder of the bearer and over the top of the second and opposed shoulder of the bearer;

attaching the second end of the shoulder strap to the waist bag on an opposite side of the receiver; and shortening the shoulder strap after the shoulder strap is passed over the second shoulder in order to raise the receiver to a second and higher position adjacent to the front of the bearer.

9. The method according to claim 8 further comprising the step of lengthening the shoulder strap in order to lower the receiver to the first position with respect to the front of the bearer.

10. The method according to claim 8 further comprising:

providing a pouch attached to the waist bag where the first end of the shoulder strap is attached, the pouch defining a compartment capable of containing the shoulder strap, and storing the shoulder strap in the pouch when the shoulder strap is not deployed.

* * * * *